US006748313B2

(12) United States Patent
Li et al.

(10) Patent No.: US 6,748,313 B2
(45) Date of Patent: Jun. 8, 2004

(54) METHOD AND SYSTEM FOR ESTIMATING CYLINDER AIR CHARGE FOR AN INTERNAL COMBUSTION ENGINE

(75) Inventors: Yonghua Li, Windsor (CA); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 87 days.

(21) Appl. No.: 10/065,538

(22) Filed: Oct. 28, 2002

(65) Prior Publication Data

US 2004/0083047 A1 Apr. 29, 2004

(51) Int. Cl.[7] ..... F02D 41/18
(52) U.S. Cl. ..... 701/102; 73/118.2
(58) Field of Search ..... 701/102, 108, 701/103, 115; 123/478, 480, 486, 399; 73/117.3, 118.2

(56) References Cited

U.S. PATENT DOCUMENTS

| | | | | | |
|---|---|---|---|---|---|
| 4,644,474 | A | | 2/1987 | Aposchanski et al. | 701/108 |
| 5,008,824 | A | | 4/1991 | Clark et al. | 701/103 |
| 5,205,260 | A | * | 4/1993 | Takahashi et al. | 73/118.2 |
| 5,331,936 | A | | 7/1994 | Messih et al. | 123/480 |
| 5,337,719 | A | | 8/1994 | Togai | 123/478 |
| 5,398,544 | A | | 3/1995 | Lipinski et al. | 73/118.2 |
| 5,423,208 | A | * | 6/1995 | Dudek et al. | 73/117.3 |
| 5,635,634 | A | | 6/1997 | Reuschenbach et al. | 73/118.2 |
| 5,889,204 | A | | 3/1999 | Scherer et al. | 73/118.2 |
| 6,308,683 | B1 | | 10/2001 | Pursifull et al. | 123/399 |
| 6,321,732 | B1 | | 11/2001 | Kotwicki et al. | 123/568.16 |
| 6,328,007 | B1 | | 12/2001 | Hirasawa et al. | 123/90.15 |
| 6,363,316 | B1 | * | 3/2002 | Soliman et al. | 123/480 |
| 6,636,796 | B2 | * | 10/2003 | Kolmanovsky et al. | 73/118.2 |

FOREIGN PATENT DOCUMENTS

JP 11-223145 A * 8/1999 ..... F02D/41/14

OTHER PUBLICATIONS

M. Jamkovic, S. W. Magner, *Air charge estimation and prediction in spark ignition internal combustion engines*, Proc. ACC, 1999.

Mrdjan Jankovic, Steve W. Magner, *Cylinder air–charge estimation for advanced intake valve operation in variable cam timing engines*, JSAE Review 22 (2001)445–452.

* cited by examiner

*Primary Examiner*—Hieu T. Vo

(57) ABSTRACT

A method is provided for estimating cylinder air charge in an internal combustion engine, such engine having a mass airflow (MAF) sensor and a manifold absolute pressure (MAP) sensor. The method provides such cylinder air charge estimation from signals produced primarily by the manifold absolute pressure sensor during engine transient conditions. During a transition period between the transient condition and a steady-state engine condition the method combines signals primarily from both the mass airflow sensor and the manifold absolute pressure sensor to provide such cylinder air charge estimation. During the steady-state condition, the method uses primarily only the mass airflow sensor to provide such cylinder air charge estimation. With such method, the cylinder air charge estimation method utilizes the advantages of both measurement sensors. When transient situation occurs, the engine controller utilizes measurements from MAP sensors (together with measurements from other less significant sensors) to produce the cylinder air charge estimation. When it is determined that the transient situation is converging to a steady state operation, a smoothing algorithm is employed to combine the measurements from both MAF and MAP sensors to produce the cylinder air charge estimation. Finally, when the engine is operating in steady state, only the MAF sensor (together with other less significant sensors) is used to produce the cylinder air charge estimation.

18 Claims, 9 Drawing Sheets

Blending:
% MAF airchg
% MAP airchg $$CAC_{FINAL} = \frac{n_p}{n_f} CAC_{MAF} + (1-\frac{n_p}{n_f}) CAC_{MAP}$$

METHOD AND SYSTEM FOR ESTIMATING CYLINDER AIR CHARGE FOR AN INTERNAL COMBUSTION ENGINE

BACKGROUND OF INVENTION

Technical Field

This invention relates to internal combustion engines, and more particularly to methods and system for estimating air charge into cylinders in such engines.

Background

As is known in the art, cylinder air charge estimation has been an essential part of engine controls for port fuel injection internal combustion engines (ICE). Such estimation is typically performed using signals from various engine sensors. For example, a method called "manifold filling" is described in U.S. Pat. No. 5,331,936 "Method and Apparatus for Inferring the Actual Air Charge in an Internal Combustion Engine During Transient Conditions", inventors I. A., Messih, L. H. Buch, and M. J. Cullen, issued Jul. 26, 1994, assigned to the same assignee as the present invention. This "manifold filling" method is used to perform air charge estimation for ICE equipped with mass airflow sensors (MAF). Another method, called "speed density", described in U.S. Pat. No. 6,115,664 "Method of Estimating Engine Charge", inventors M. J. Cullen and C. D. Suffredini, issued Sep. 5, 2000, assigned to the same assignee as the present invention, is used to perform air charge estimation for ICE equipped with manifold absolute pressure sensors (MAP). It should be noted that other sensors, for example, throttle angle sensor, inlet air charge temperature sensor, engine coolant temperature sensor, etc., may also be required.

As is also known in the art, both the MAF-based manifold filling method and the MAP-based speed density method have their respective strengths and weaknesses, see_Toc9674602 an article by entitled "Cylinder air-charge estimation for advanced intake valve operation in variable cam timing engines_Toc9674602" by Mrdjan Jankovic and Steve W. Magner, published in JSAE Review 22 (2001) 445 452. The main advantage of MAF is that, in steady state operation, it actually measures the cylinder: mass airflow. The challenge is, therefore, to accurately account for the intake manifold filling and emptying during transient operations such as large rapid tip-in/tip-out conditions. Compared with an MAF sensor, the main advantages of the MAP sensor are its relative proximity to the engine air intake port and lower cost. On the other hand, MAP based air charge estimation does not have as good a steady state property as compared with an MAF based air charge estimation.

For some applications, a single method such as manifold filling or speed density, may not work adequately to provide the required accuracy for air charge estimation. For example, as discussed in U.S. Pat. No. 5,398,544, "Method and system for determining cylinder air charge for variable displace internal combustion engine" inventors, D. Lipinski, D. Robichaux, issued Mar. 21, 1995, assigned to the same assignee as the present invention, in a Variable Displacement Engine when operation modes change from a first number of cylinders to a different number of cylinders, the MAF based air charge estimation method may not always be able to provide accurate air charge estimation during the transient operation between such modes due to the limited bandwidth of the MAF sensor.

Several approaches have been developed in the past decade or so in order to improve the accuracy of air charge estimation. One approach is described in U.S. Pat. No. 5,889,204 "Device for determining the engine load for an internal combustion engine", inventors M. Scherer, T. Ganser, and R. Wilczek. With such approach, a Kalman-filter type estimator is used to estimate air charge. More particularly, a Kalman filter is used to estimate manifold pressures at the beginning and end of a working cycle. An air charge estimation is obtained by adding the estimated mass air flow in throttle to an amplified difference value of the two manifold pressures as calculated by the Kalman filter, with the amplification coefficient calibrated before hand. It is noted however that the Kalman filter, which is nonlinear and stochastic, is very difficult to obtain. Further, the final output may have the drawbacks of both manifold filling and speed-density approaches.

SUMMARY OF INVENTION

In accordance with the present invention, a method is provided for estimating cylinder air charge (CAC) in an internal combustion engine, such engine having a mass airflow (MAF) sensor and a manifold absolute pressure (MAP) sensor. The method provides such cylinder air charge estimation from signals produced primarily by the manifold absolute pressure sensor during engine transient conditions, i.e., during a change in an engine operating parameter, e.g., throttle plate position change, valve timing change, change in the number of operating cylinders in a variable displacement engine, variable cam timing change, change in lift with a variable valve lift engine. During a transition period between the transient condition and a steady-state engine condition the method combines signals primarily from both the mass airflow sensor and the manifold absolute pressure sensor to provide such cylinder air charge estimation. During the steady-state condition, the method uses primarily only the mass airflow sensor to provide such cylinder air charge estimation.

In accordance with the present invention, a method is provided for estimating cylinder air charge (CAC) in an internal combustion engine. The method provides such cylinder air charge estimation using a speed density algorithm during engine transient conditions. During the steady-state condition, the method provides such cylinder air charge estimation using a manifold filling algorithm. During a transition period between the transient condition and a steady-state engine condition the method combines the estimation from the manifold filling algorithm with the estimation from the speed density algorithm to provide such cylinder air charge estimation.

With such method, the cylinder air charge estimation method utilizes the advantages of both measurement sensors and corresponding air charge estimation algorithms. When transient situation occurs, the engine controller utilizes measurements from MAP sensors together with measurements from other less significant sensors to produce the cylinder air charge estimation. When it is determined that the transient situation is converging to a steady state operation, a smoothing algorithm is employed to combine the measurements from both MAF and MAP sensors, together with measurements from other less significant sensors, to produce the cylinder air charge estimation. Finally, when the engine is operating in steady state, only the MAF sensor, together with measurements from other less significant sensors, is used to produce the cylinder air charge estimation.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
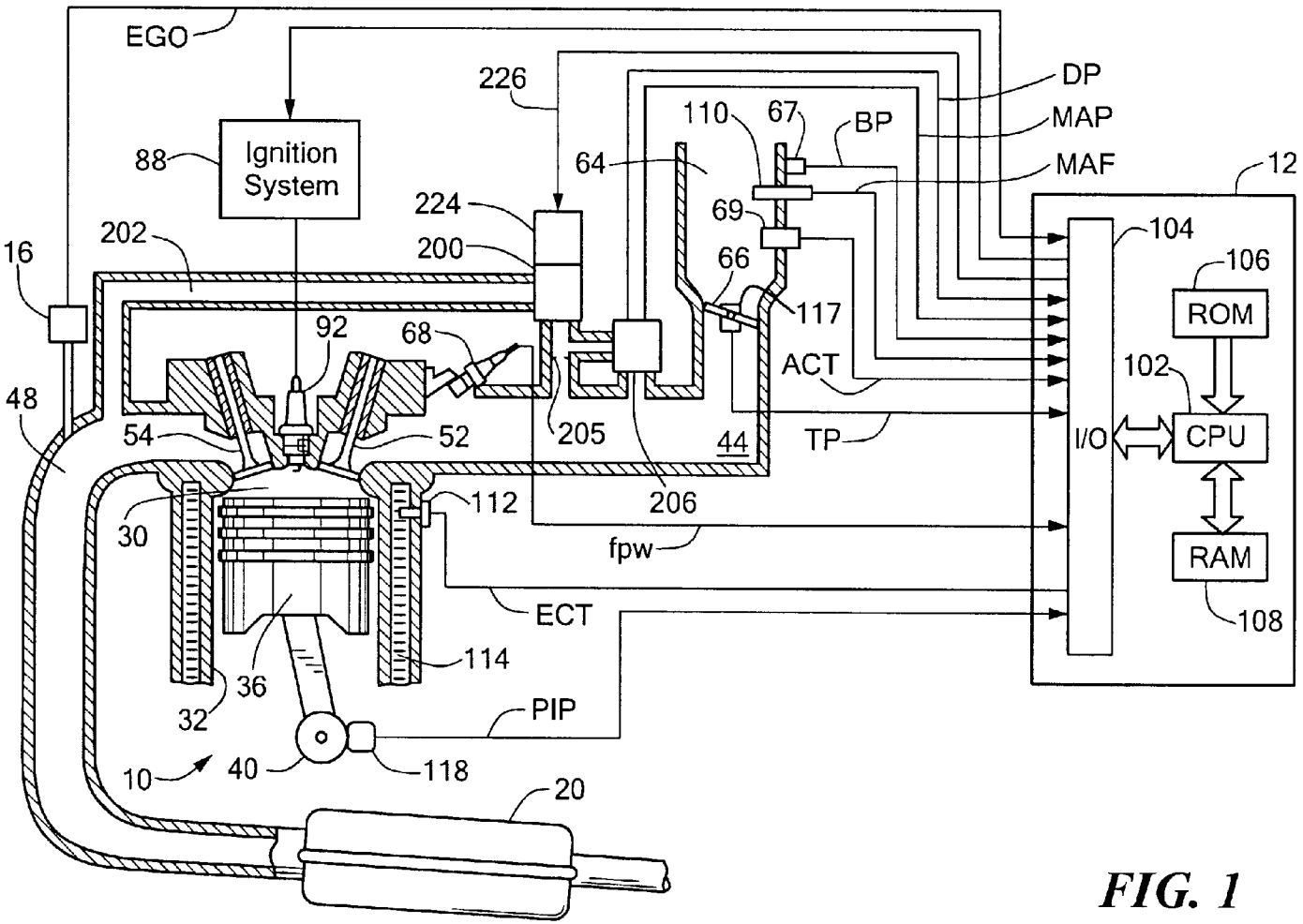
FIG. 1 is a diagrammatical sketch of an engine system using cylinder air charge estimation according to the invention.

Referring now to FIG. 1, an internal combustion engine system 10 is shown. The internal combustion engine 10 comprises a plurality of cylinders, one cylinder of which is shown in FIG. 1. The engine 10 is controlled by electronic engine controller 12. Engine 10 includes combustion chamber 30 and cylinder walls 32 with piston 36 positioned therein and connected to crankshaft 40. Combustion chamber 30 communicates with intake manifold 44 and exhaust manifold 48 via respective intake valve 52 and exhaust valve 54.

Intake manifold 44 communicates with throttle body 64 via throttle plate 66. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown). Engine 10 further includes conventional distributor less ignition system 88 to provide ignition spark to combustion chamber 30 via spark plug 92 in response to controller 12. In the embodiment described herein, controller 12 is a conventional microcomputer including: microprocessor unit 102, input/output ports 104, electronic read-only-memory (ROM) chip 106, which is an electronically programmable memory in this particular example, random access memory 108, and a conventional data buses, as indicated.

The controller 12 receives various signals from sensors coupled to engine 10 including: measurements of inducted mass air flow (MAF) from mass air flow sensor 110 coupled to throttle body 64; engine coolant temperature (ECT) from temperature sensor 112 coupled to cooling jacket 114; a measurement of manifold absolute pressure (MAP) from MAP sensor 206 coupled to intake manifold 44; a measurement of throttle position (TP) from throttle position sensor 117 coupled to throttle plate 66; and a profile ignition pickup signal from sensor 118. Also shown is a barometric pressure sensor (BP) 67. (It should be understood that in production engine control systems, the BP sensor 67 is usually not used due to cost consideration.) Instead, a value called "inferred BP" is used in control algorithm development, including cylinder air charge estimation. The BP sensor is shown here in order to simplify the presentation. Also included is an air charge temperature (ACT) sensor 69 which feed signals to controller 12. Exhaust gas is delivered to intake manifold 44 by a conventional EGR tube 202 communicating with exhaust manifold 48, EGR valve assembly 200, and EGR orifice 205. Vacuum regulator 224 is coupled to EGR valve assembly 200. Vacuum regulator 224 receives actuation signal (226) from controller 12 for controlling valve position of EGR valve assembly 200. Exhaust gas travels from exhaust manifold 44 to a three-way catalyst (TWC) 20, as shown.

MAP sensor 206 provides a measurement of manifold absolute pressure (MAP) and pressure drop across orifice 205 (DP) to controller 12.

There are other components, such as EGO sensor 1 6, which are important to the overall engine control system function.

Figure 2:
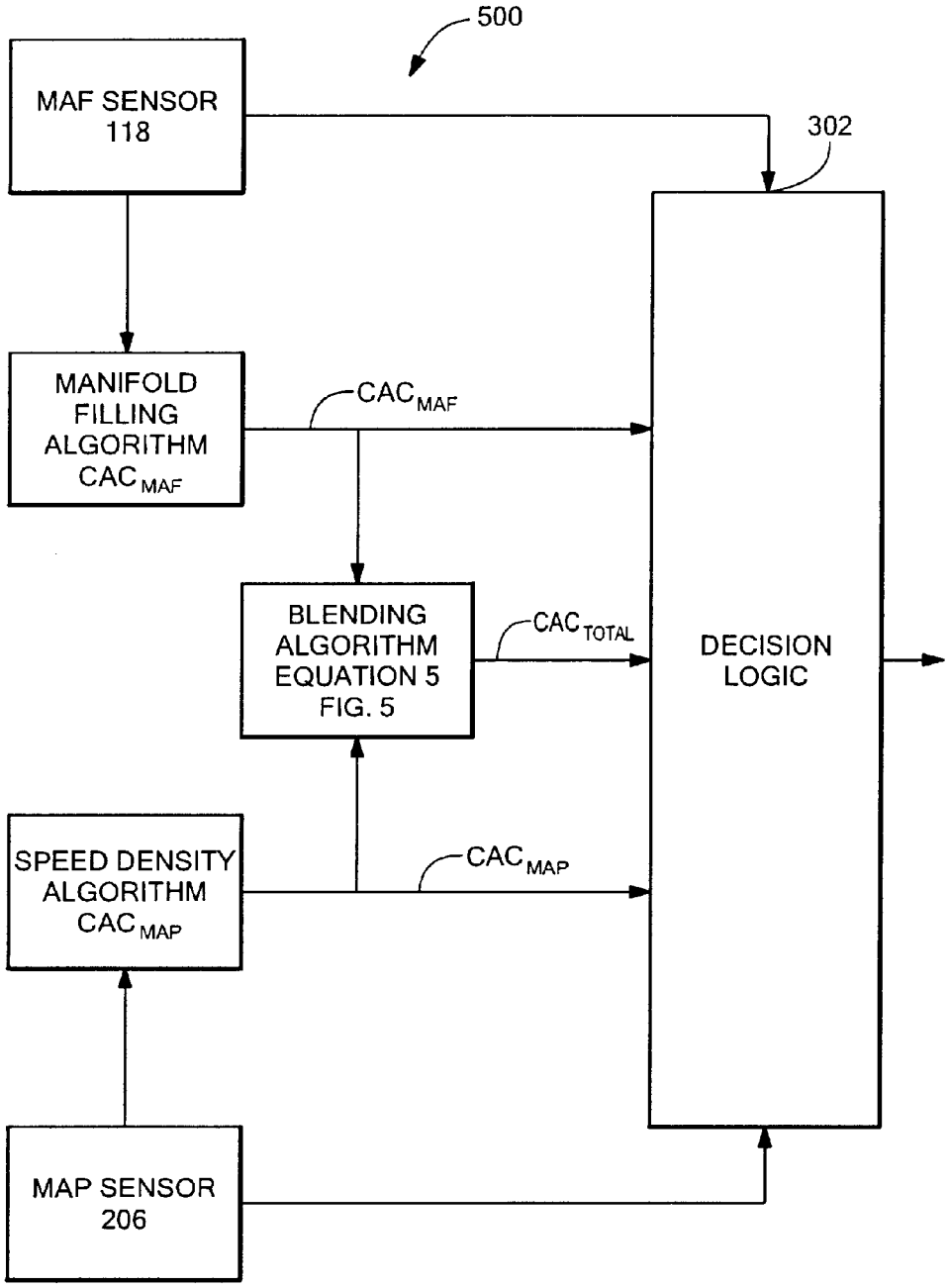
FIG. 2 is a block diagram of the cylinder air charge estimation module used in the engine system of FIG. 1 according to the invention.

A cylinder air charge estimator module 500 is shown in more detail in FIG. 2, it should be understood that such module 500 is a software module stored in the ROM of controller 12.

In operation, upon detecting each PIP up and down signal produced by PIP (profile ignition pickup) sensor 118 (FIG. 1), the signal produced by the MAF sensor 110 is sampled by controller 12 to provide a cylinder air charge filling strategy as described. in the above referenced U.S. Pat. No. 5,331,936 "Method and Apparatus for Inferring the Actual Air Charge in an Internal Combustion Engine During Transient Conditions", inventors I. A., Messih, L. H. Buch, and M. J. Cullen, the entire subject matter thereof being incorporated herein by reference. Also, the signal produced by the MAP sensor 206 is sampled by controller 12 to provide a cylinder air charge estimation using the speed density strategy as described in the above referenced U.S. Pat. No. 6,115,664 "Method of Estimating Engine Charge", inventors M. J. Cullen and G. D. Suffredini, issued Sep. 5, 2000, the entire subject matter thereof being incorporated herein by reference. As will be described, the signals produced by both the MAF sensor 112 and the MAP sensor 206 are used to provide a transitioning cylinder air charge estimation in accordance with this invention. In addition, the throttle position (TP) sensor 117 is sampled, and the engine speed signal, N, is calculated by the controller 12 upon detecting each PIP sensor 112 up and down output signal. The other sensors such as ECT and ACT are sampled in a fixed rate (i.e., background execution of other software programs stored in the memory of controller 12).

With the detection of all the relevant signals, the air charge estimation module 500 produces an estimation of cylinder air charge (in the form of cylinder air charge and load) for the use of other parts of the engine control system via the controller 12.

As it is mentioned above, the MAF sensor 110 and MAP sensor 206 have their own merits and disadvantages. A MAF sensor based cylinder air charge estimation method (manifold filling) provides accurate cylinder air charge estimation when the system is operating in (or near) steady state. A MAP sensor based cylinder air charge estimation (speed density) provides a sufficiently accurate cylinder air charge estimation while tracking changes in intake air flow, but its measurement is considered less accurate than MAF sensor during steady state operation. Speed density cylinder air charge estimation depends heavily on calibrated coefficients.

In order to explain the invention, assume the operator is cruising on the highway, then pushes the accelerator pedal to demand torque, and then maintains this position for a period of time (i.e., the operator introduces a tip-in condition to the engine). The electronic throttle controller software module, not shown, stored as executable computer code stored in ROM 106 of the controller 12 will correspondingly control the throttle plate 66 via the TP signal from controller 12 so as to following the torque demand of the driver. As the throttle plate 66 angle becomes larger, the MAF sensor 110 will sense the sudden increase of airflow via MAF sensor 110 (although the response is not as fast as throttle plate 66 rotates). Based on a calibrated threshold value, the cylinder air charge estimation module 500 (FIG. 2) determines if a large tip-in has occurred.

Assume that a large tip-in has indeed occurred. Also assume the throttle plate 66 angle changes from $\theta_1$ to $\theta_2$. Assuming the ideal gas law for the manifold:

$$PV=mRT \qquad \text{Equation 1}$$

where:

P is the intake manifold absolute pressure (MAP);

V is the intake manifold volume;

m is the mass airflow rate (MAF) in the intake manifold 44;

R is a gas constant; and

T is the temperature (ACT) inside the intake manifold 44.

Taking the derivative on both side of Equation 1, and assume that the derivative of temperature T is zero:

$$\dot{P} = \frac{RT}{V}\dot{m} = \frac{RT}{V}(M_\theta - M_{cyl}) \qquad \text{Equation 2}$$

where:

$M_{cyl}$ is the air mass flow to the cylinder (CAC); and $M_\theta$ is the air mass flow (MAF) through the intake throttle plate 66, which can be represented by the following equation:

$$M_\theta = \frac{P}{\sqrt{RT}} G(\theta)\Psi(P/BP) \qquad \text{Equation 3}$$

where:

BP is the barometric pressure;

the function $G(\theta)$ is system dependent;

the function $\psi$ (P/BP) can be expressed as:

$$\Psi(P/BP) = \begin{cases} 1.0; \text{ if } (P/BP) \le 0.5285 \\ \sqrt{14.965 * \left(\left(\frac{P}{BP}\right)^{1.4296} - \left(\frac{P}{BP}\right)^{1.7148}\right)}; \text{ otherwise} \end{cases} \qquad \text{Equation 4}$$

Due to the existence of air mass filling dynamics in the intake manifold 44, a sudden opening of the throttle plate 66 would not lead to proportional increase in cylinder air charge. Instead, there will be a transient response in the MAF sensor 110. A typical reading is shown in FIG. 3, From FIG. 3, it is clear that the readings from the MAF sensor 110 would be deviated from the actual cylinder air charge value.

As the transient response dissipates, the MAF sensor 110 reading is again in steady state and it provides accurate cylinder air charge estimation for engine control purposes. From the above equations, it is clear that this steady state value is a function of the new throttle plate 66 angle, together with other variables.

Figure 3:
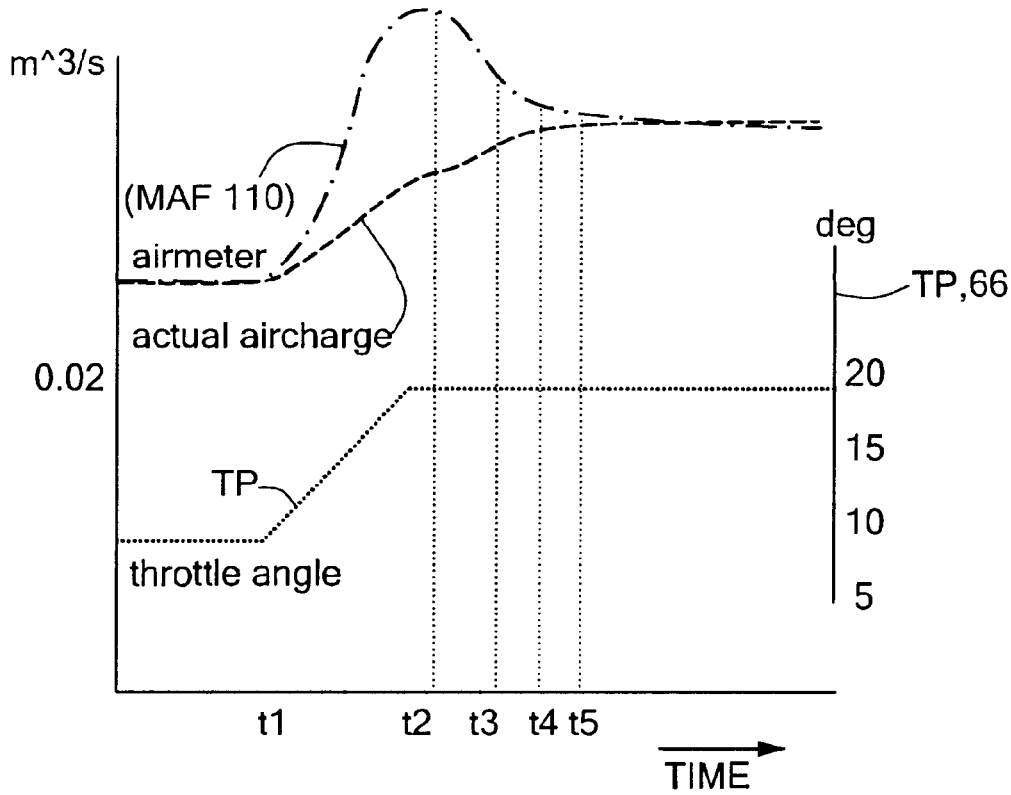
FIG. 3 is a time history of a change in throttle angle of an engine system and the measured mass airflow and actual cylinder air charge produced in response to such throttle angle change.

When there is just a single large tip-in (or tip-out, i.e., the operator releases the accelerator pedal) event, or equivalently, there is a sufficiently large change in throttle plate 66 position, from FIG. 3, the transient will go up (for a tip-in, whereas if it were a tip-out, then it would go down), reach a maximum value at t2, and then goes smoothly to a steady state value. In the process of reaching the steady state value, there will be a time when the absolute values of the differences in the MAF sensor 110 readings decrease. This indicates that the transient response of the MAF sensor 110 is going to dissipate.

In accordance with the present invention, a method is provided for estimating cylinder air charge (CAC) in an internal combustion engine (ICE). The method provides such cylinder air charge estimation from signals produced primarily by the MAP sensor 206 during engine transient conditions. During a transition period between the transient condition and a steady-state engine condition the method combines signals primarily from both the MAF sensor 110 and the MAP sensor 206 to provide such cylinder air charge estimation. During the steady-state condition, the method uses primarily only the MAF sensor 110 to provide such cylinder air charge estimation.

With such method, the cylinder air charge estimation method utilizes the advantages of both the MAF sensor 110 and the MAP sensor 206. When transient situation occurs, the engine controller utilizes measurements from MAP sensor 206 (together with measurements from other less significant sensors) to produce the cylinder air charge estimation. When it is determined that the transient situation is converging to a steady state operation, a smoothing algorithm is employed to combine the measurements from both MAF sensor 110 and the MAP sensor 206 (together with measurements from other less significant sensors) to produce the cylinder air charge estimation. Finally, when the engine is operating in steady state, only the MAF sensor 110 (together with measurements from other less significant sensors) is used to produce the cylinder air charge estimation. In order to reflect the fact that the transient response goes to steady state in an asymptotic fashion, a smoothing operation, to be described, is used to bridge the manifold filling algorithm described in the above-referenced U.S. Pat. No. 5,331,936), which uses the MAF sensor output, and the speed density algorithm output (described in U.S. Pat. No. 6,115,664), which uses the MAP output.

Figure 5:
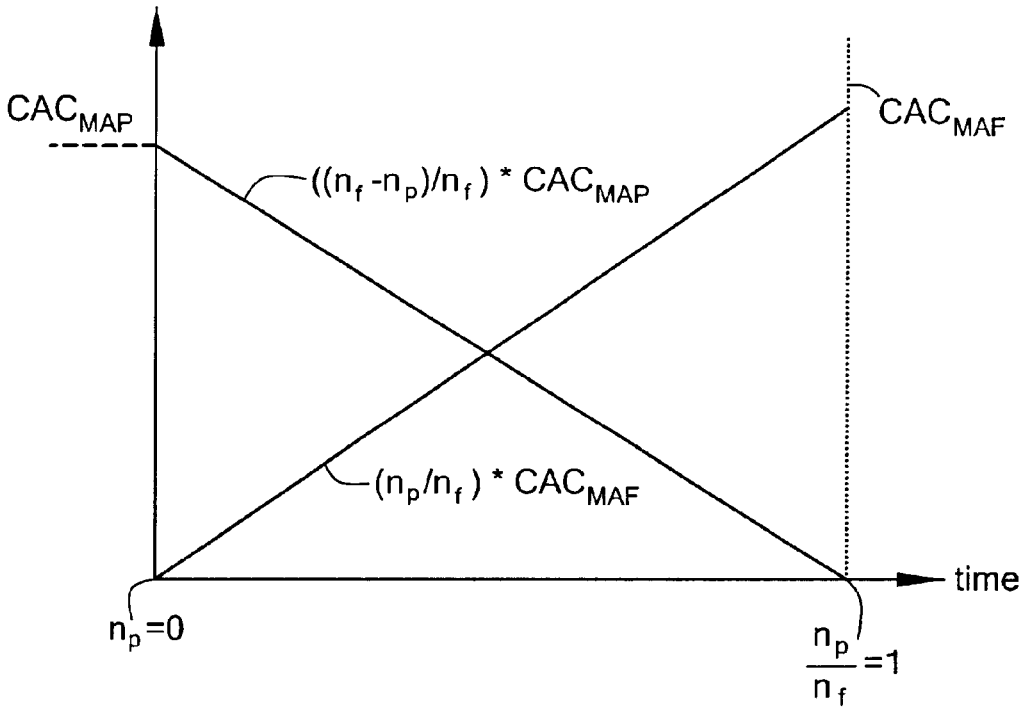
FIG. 5 shows cylinder air charge estimation as a function of time (in terms of engine combustion event PIP (profile ignition pickup) counter) when such estimation uses a smooth transitional blending from use of an estimation based on signals from a manifold absolute pressure sensor in the engine system of FIG. 1 to an estimation based on signals from a mass airflow sensor used in the engine system of FIG. 1 according to the invention.

More particularly, the smoothing algorithm is shown in FIG. 5 and is expressed below in equation 5:

$$CAC_{FINAL} = \frac{n_p}{n_f} CAC_{MAF} + \frac{n_f - n_p}{n_f} * CAC_{MAP} \qquad \text{Equation 5}$$

where:

$CAC_{MAF}$ is the cylinder air charge estimation based on manifold filling algorithm calculation. Here, the manifold filing algorithm is described in the above-referenced U.S.

Pat. No. 5,398,544, "Method and Apparatus for Inferring the Actual Air Charge in an Internal Combustion Engine During Transient Conditions", inventors I. A., Messih, L. H. Buch, and M. J. Cullen, issued Jul. 26, 1994 and uses primarily the signal produced by MAF sensor 110;

$CAC_{MAP}$ is the cylinder air charge estimation based on speed density algorithm calculation. Here, the speed density algorithm is described in U.S. Pat. No. 6,115,664 "Method of Estimating Engine Charge", inventors M. J. Cullen and G. D. Suffredini, issued Sep. 5, 2000, referred to above, and uses primarily the signal from MAP 206;

$n_f$ is calculated from a calibrated mapping function indicating the length of the smoothing process, i.e., the total time (in terms of PIP sensor 118 output count) for the blending provided by the smoothing algorithm (Equation 5, FIG. 5); and $n_p$ is the PIP sensor 118 output count since the smoothing started, i.e., the current time duration (in terms of PIP sensor 118 output count) of the blending provided by the smoothing algorithm in equation 5, FIG. 5.

Thus, the fraction of time the blending provided by the smoothing algorithm is $n_p/n_f$.

Thus, referring to FIG. 5, $CAC_{MAP}$ (which is determined primarily from signal produced by MAP 206) and $CAC_{MAF}$ (which uses signals primarily from MAF 110) are shown as a function of time. It is noted that initially (i.e., when $n_p=0$), $CAC_{TOTAL}$ is $CAC_{MAP}$ and that at the end of the smoothing, or blending, process, (i.e., when $n_f=n_p$) $CAC_{TOTAL}$ is $CAC_{MAF}$.

It should be noted that there are possible variations to the above-mentioned formula in equation 5 to provide a smooth transitional blending from $CAC_{MAP}$ to $CAC_{MAF}$.

In practice, not all large tip-ins or tip-outs are isolated. For example, when there is a large tip-in (or large tip-out), the operator may consequently command a series of small tip-out (tip-in). For ICE equipped with Electronic Throttle Controllers, it is more likely that this will happen.

If a subsequent large tip-in or tip-out occurs, it is treated as a new large tip-in or tip-out. The amplitude and duration of the sequence of same-sign tip-in/tip-out are recorded and used later. In particular, if a large tip-in (or tip-out) followed immediately by another large tip-in (or tip-out), the amplitude and duration of tip-in (or tip-out) are added together to better describe the tip-in (or tip-out).

Figure 4:
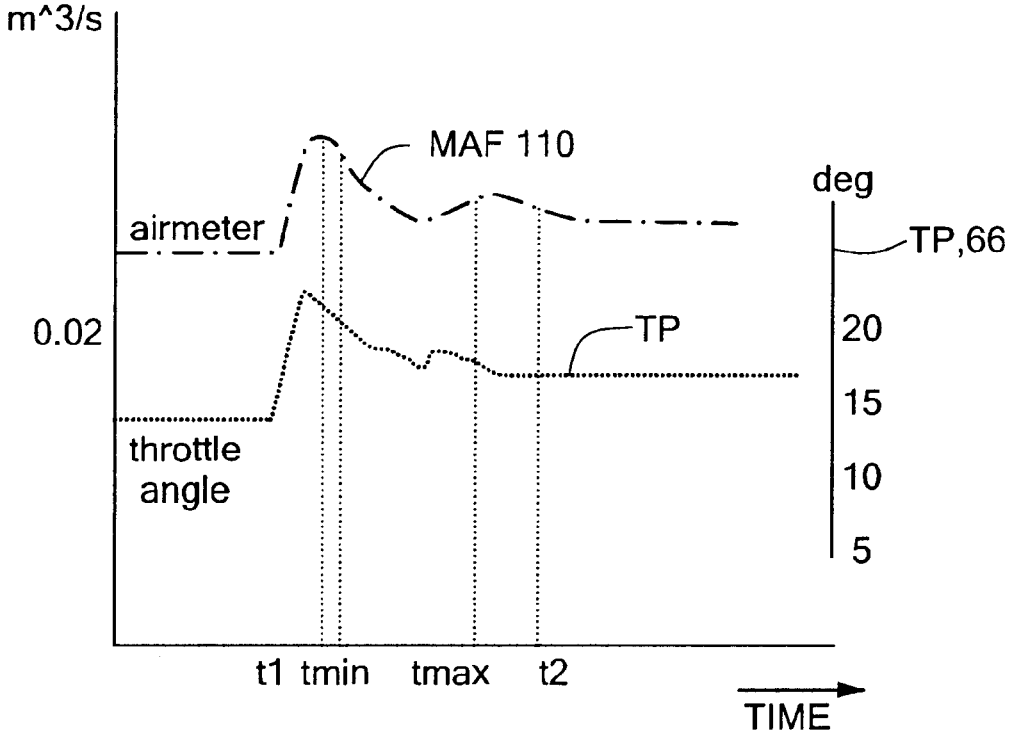
FIG. 4 is a time history of changes in throttle angle of an engine system and the measured mass airflow in response to such throttle angle changes.

If a large tip-in occurs, followed with several small tip-outs, the MAF sensor 110 reading may not be as shown in FIG. 3. The converging pattern from t3–t5 may never occur. On the other hand, it may be possible that the converging pattern from t3–t5 as shown in FIG. 3 occurs immediately after a large tip-in or tip-out is detected, physically, this is not due to the detected large tip-in or tip-out starting to dissipate; or it may be possible that the converging pattern from t3–t5 as shown in FIG. 3 occurs at a time which is longer than a tip-in (or tip-out) event would last. In order to clearly demonstrate the above, reference is made to FIG. 4, where t1 is the time when a converging condition is detected, while it is smaller than physically possible time, tmin. On the other hand, reference is again made to FIG. 4, where t2 is the time when a converging condition is detected, which is larger than a physically possible time, tmax. All these converging patterns are not considered caused by the large tip-in (or tip-out) occurred as shown in FIG. 4.

In order to prevent these potential problems, two timers (in terms of PIP sensor 118 output count), not shown, are used in controller 12. The first one is a minimal counter; the second one is a maximum counter. If, after a large tip-in (or tip-out), a converging pattern is detected, as will be described below in connection with FIG. 6A, but it occurs within the minimum counter value, then it is determined to be invalid and the smoothing algorithm, which interpolates the cylinder air charge estimation from both the manifold filling and speed density algorithms, is not applied. On the other hand, if, after a large tip-in (or tip-out) is detected but no converging pattern is detected after a maximum counter value, then the smoothing algorithm, which interpolates the cylinder air charge estimation from both the manifold filling and speed density algorithms, is forced to be applied. Thus, when a transient response is almost over, a smoothing process is used to obtain composite cylinder air charge estimation. The smoothing process is a linear combination of the manifold filling algorithm output and the speed density algorithm output, as described above in equation 5 and FIG. 5.

Figure 6:
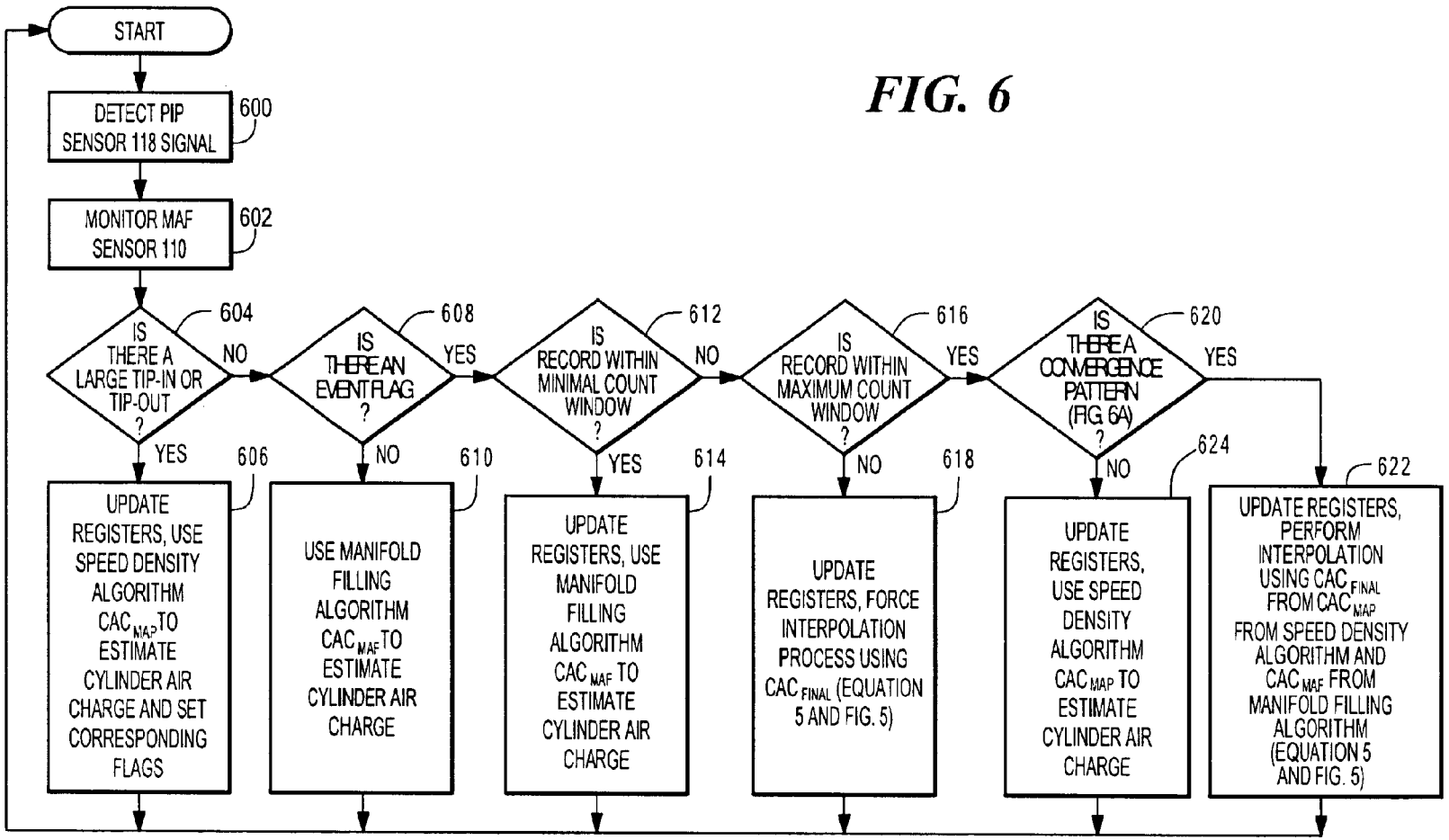
FIG. 6, together with FIG. 6A, describes the process used to estimate cylinder air charge in accordance with the invention.

Combining the above discussion, and referring to FIGS. 2 and 6, a hybrid cylinder air charge estimation algorithm is used. Referring first to FIG. 2, a decision logic 302 is fed cylinder air change estimation using the manifold filling algorithm, $CAC_{MAF}$, the speed density algorithm $CAC_{MAP}$; and a blending $CAC_{TOTAL}$, as described above in equation 5 and FIG. 5. Following a large tip-in (or tip-out), within the minimal PIP sensor 118 output count window, the decision logic 302 selects $CAC_{MAP}$ as the estimation for the cylinder air charge; following a large tip-in (tip-out), if there is no converging pattern in between the minimal and maximum count window (as will be described in connection with FIG. 6A), the decision logic 302 selects $CAC_{MAP}$ as the estimation for the cylinder air charge, $CAC_{FINAL}$, otherwise, if there is a detected converging pattern between the minimal and maximum count window (i.e., convergence as will be described in connection with FIG. 6A), the decision logic 302 selects $CAC_{TOTAL}$ as the estimation for the cylinder air charge, $CAC_{FINAL}$; following a large tip-in (tip-out), if no converging pattern is detected between the minimal and maximum PIP sensor 118 output count window (i.e., convergence as will be described in connection with FIG. 6A), the decision logic 302 selects $CAC_{TOTAL}$ as the estimation for the cylinder air charge after the maximum PIP sensor 118 output count window; finally, following a large tip-in (tip-out), after the $CAC_{TOTAL}$ is selected either in between the minimal and maximum PIP sensor 118 output count window (i.e., convergence as will be described in connection with FIG. 6A), or after the maximum PIP sensor 118 output count window (i.e., convergence as will be described in connection with FIG. 6A), referring to Equation 5, when n is counted to $n_f$, $CAC_{TOTAL}$ is reduced to $CAC_{MAF}$; tip-in (tip-out) related flags; and registers in the CPU 102 are reset and the decision logic 302 selects $CAC_{MAF}$ as the estimation for the cylinder air charge.

This algorithm is shown by the flow diagram in FIG. 6. In Step 602, upon detection of a PIP sensor 118 signal in Step 600, the MAF sensor is monitored. If a large tip-in or tip-out (as specified through calibration) is detected in Step 604, a corresponding tip_flag is set to 1 (or 1) and the speed density algorithm is used to calculate the cylinder air charge, i.e., calculate $CAC_{MAP}$ (Step 606) and set tip_flag to 1 for tip-in and 1 for tip-out.

On the other hand, if in Step 604 no large tip-in or tip-out is-detected, and no such event (tip_flag) is in record (Step 608), the manifold filling algorithm is to calculate the cylinder air charge, i.e., calculate $CAC_{MAP}$ (Step 610).

If, however, in Step 608, a tip_flag is detected (i.e., a tip_flag=1, or tip_flag=−1, is in the record), $CAC_{FINAL}$ as described in FIG. 2, is used to perform the cylinder air charge estimation. More particularly, if current PIP sensor 118 count from such a tip_flag=1 (or tip_flag=−1) is within a minimal count window (Step 612), the speed density algorithm is used to perform the cylinder air charge estimation, i.e., calculate $CAC_{MAP}$, Step 614, and the related registers in the CPU 102 used to store calculated variables used in this process are updated. If, in Step 616, it is determined that the tip_flag=1 (or tip_flag=−1 for tip-out) record is outside a maximum count window, an interpolation process is forced and the cylinder air charge estimation based on equation 5 is used (i.e., a smooth transition for speed density algorithm ($CAC_{MAP}$) to manifold filling algorithm ($CAC_{MAF}$) as shown in FIG. 5), Step 618. In doing the interpolation process, if the cylinder air change estimation is logically reduced from the speed density algorithm $CAC_{MAP}$ to the manifold filling algorithm $CAC_{MAF}$, based on: (1) the PIP count since the interpolation starts; and (2) a pre-determined number based on engine speed, amplitude and duration of tip-in (tip-out), the interpolation process is terminated and, then, the tip_flag and other registers related to the current tip-in (or tip-out) are all reset.

Figure 6A:
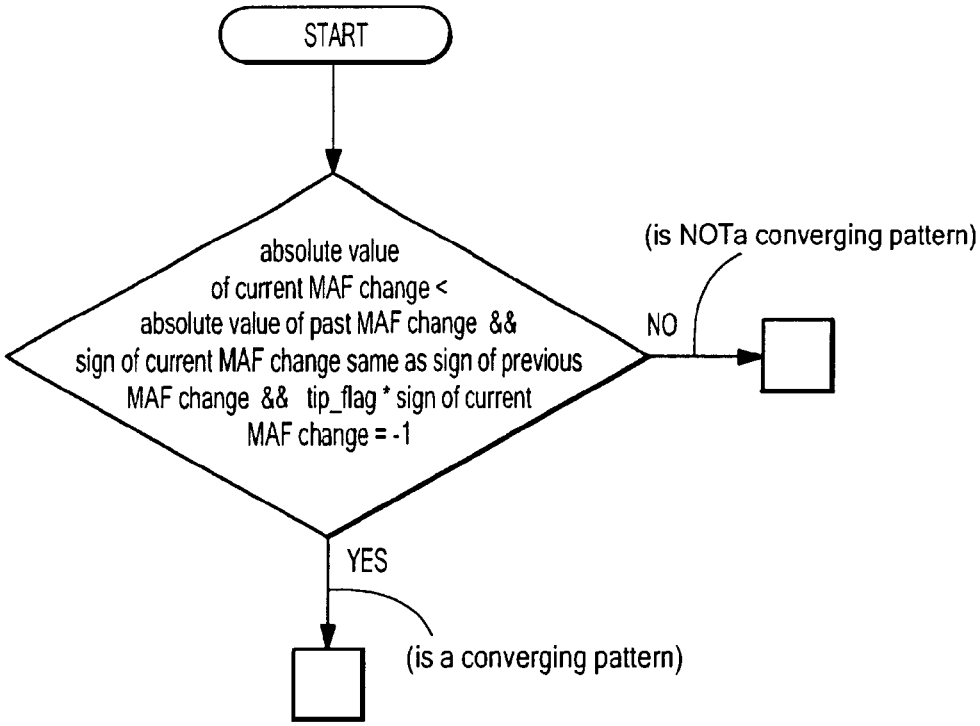

If, in Step 616 it is determined that such a tip_flag=1 (or tip_flag=−1 for tip-out) record is outside the minimal count window but inside the maximum count window, a test is made to detect whether there is a converging pattern (FIG. 6A), Step 620. This is done by comparing the absolute value of current MAF sensor 110 reading change, the absolute value of past MAF sensor 110 reading change, the signs of both MAF sensor 110 reading changes, and the sign and value of tip_flag (i.e. 1 for tip-in, −1 for tip-out, 0 for not set), as shown in FIG. 6A. If the absolute value of the current MAF sensor 110 is less than the absolute value of the past MAF sensor 110 change, and if the algebraic sign of the current MAF sensor 110 change is the same as the algebraic sign of the past MAF sensor 110 change, and if the product of the tip_flag times the signal of the current MAF sensor 110 change equals −1, a converging pattern is detected; otherwise, there isn't a converging pattern. Mathematically, a converging pattern refers to the condition that the absolute value of the first derivative of the curve is getting smaller and smaller over time. i.e., the curve is converging to a steady state value.

If there is a converging pattern detected in Step 620, the interpolation process (i.e., equation 5 and FIG. 5) is used to perform a smooth transition from the speed density algorithm ($CAC_{MAP}$) to manifold filling algorithm ($CAC_{MAF}$), Step 622 (FIG. 6). In doing the interpolation process, if the cylinder air change estimation is logically reduced from the speed density algorithm $CAC_{MAP}$ to the manifold filling algorithm $CAC_{MAF}$, based on: (1) the PIP count since the interpolation starts; and (2) a pre-determined number based on engine speed, amplitude and duration of tip-in (tip-out), the interpolation process is terminated and the tip_flag and other registers related to the current tip-in (or tip-out) are all reset. If a converging pattern is not detected in Step 620, cylinder air charge estimation is obtained by using speed density algorithm ($CAC_{MAP}$), Step 624.

This algorithm is repeated as each new PIP signal occurs.

Figure 7A:
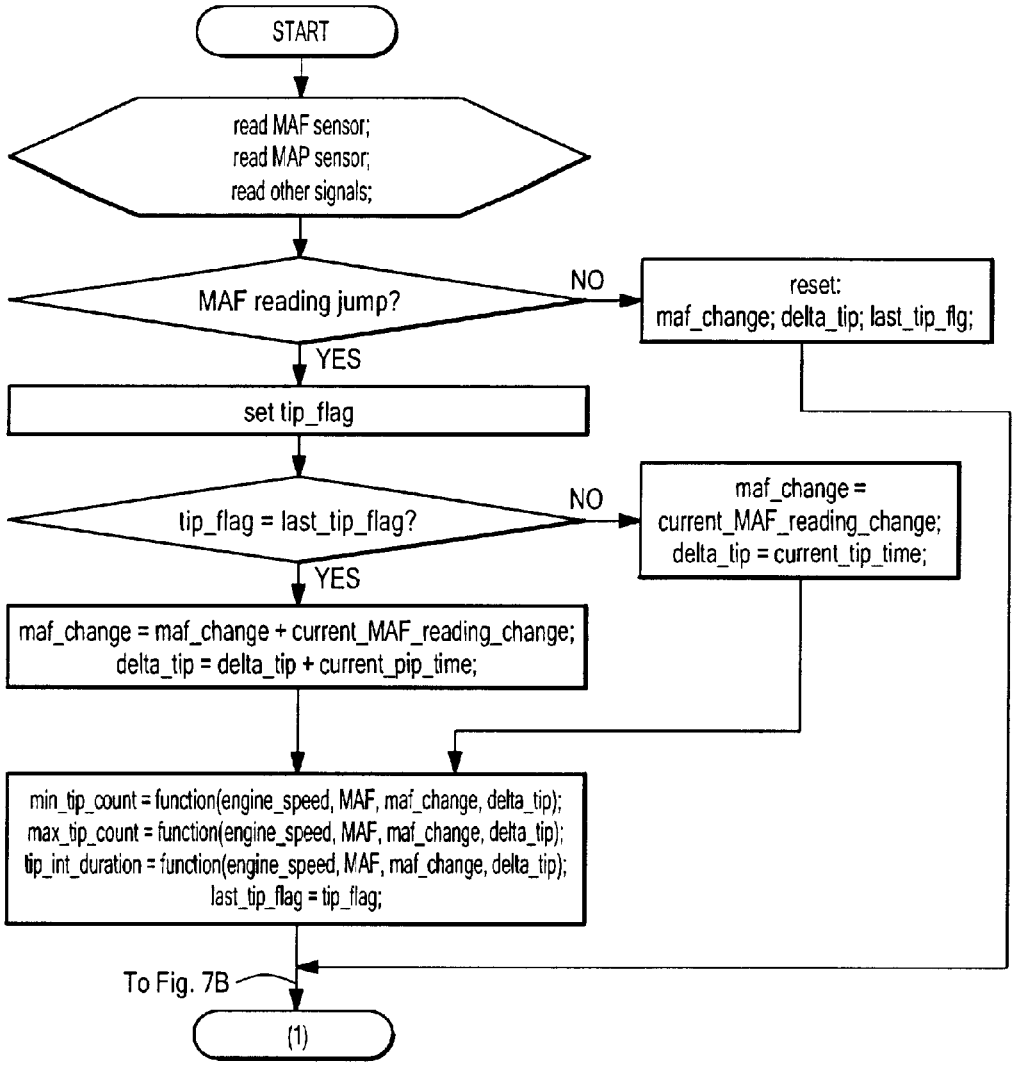
FIGS. 7A–7C together provide a more detailed flow diagram the process used to estimate cylinder air charge in accordance with the invention.
Figure 7B:
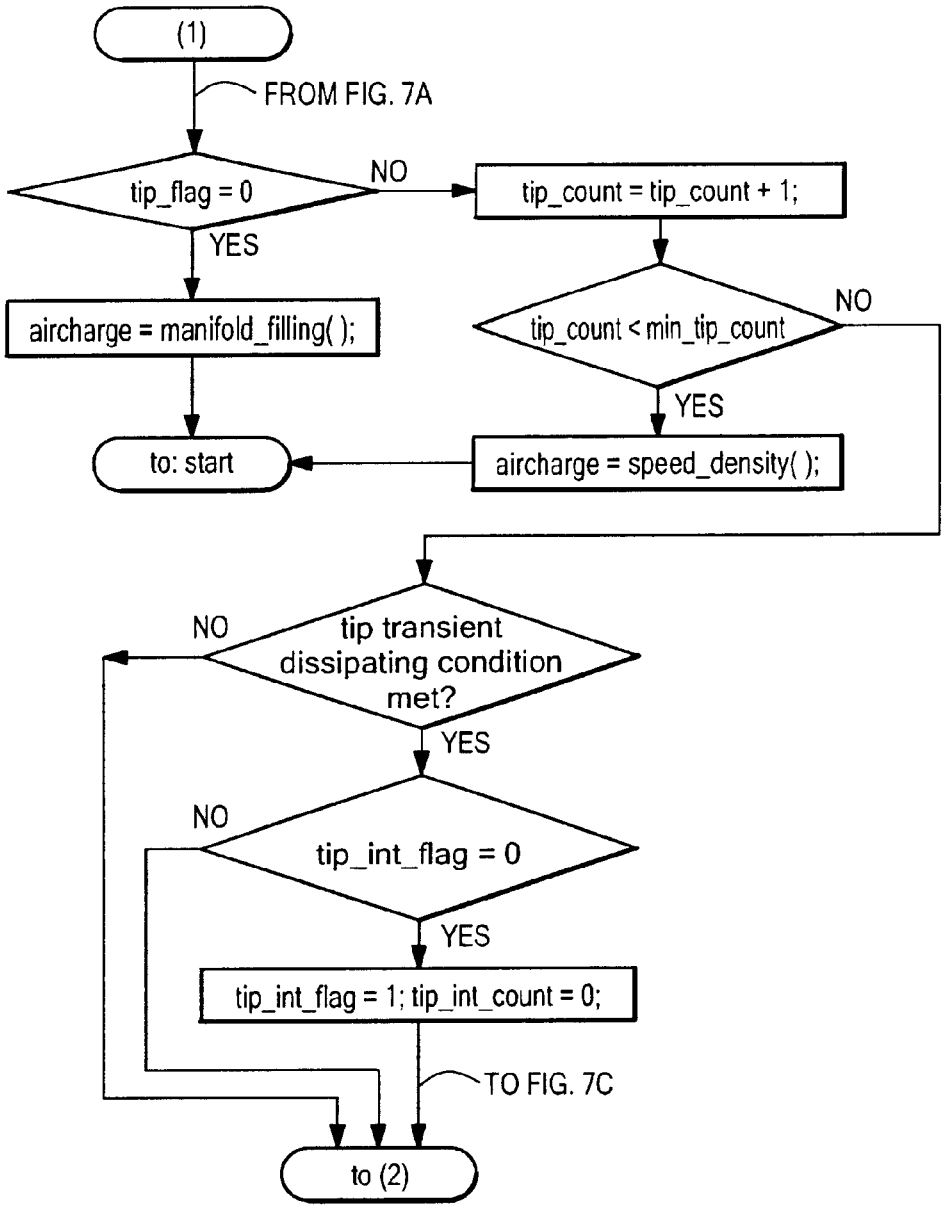
Figure 7C:
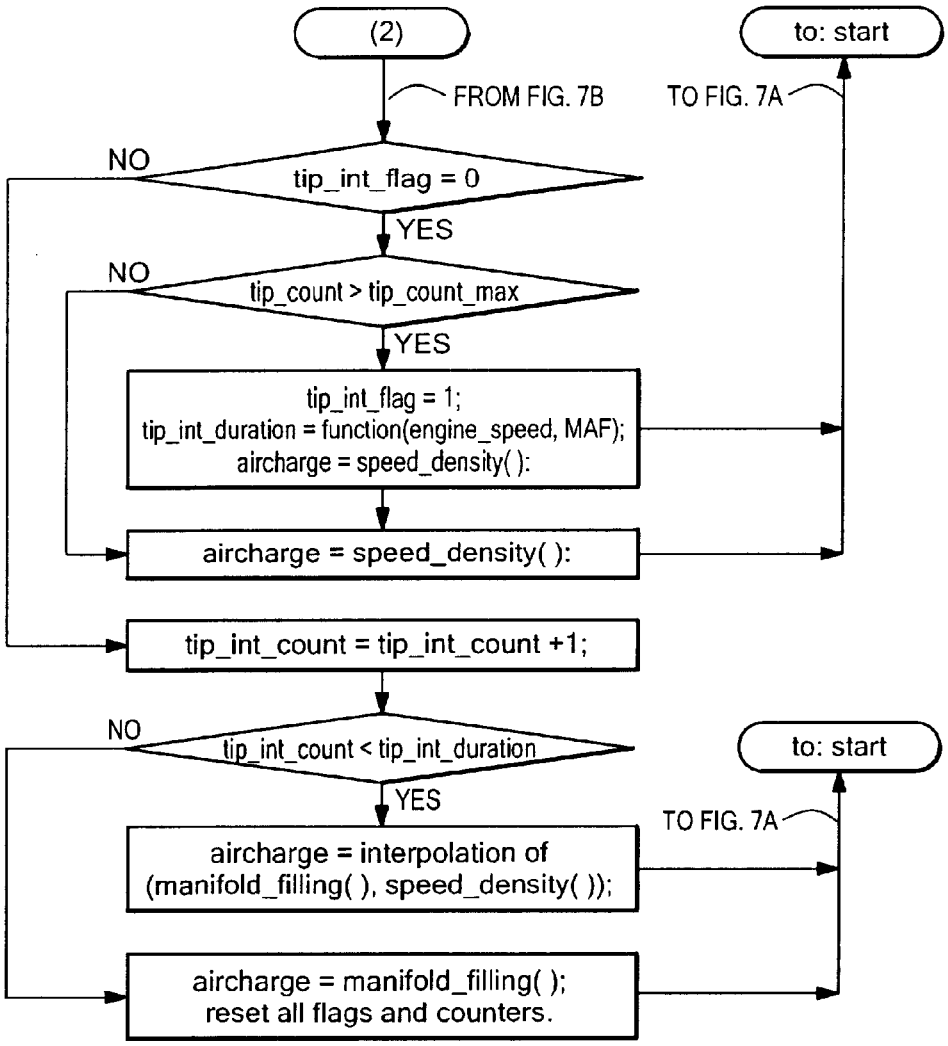

The above algorithm is presented in more detail in the flow diagram FIGS. 7A–7C wherein the following nomenclature is used:

maf_change=change in MAF sensor 110 output readings;

delta_tip=cumulative PIP sensor 118 output times for a current reading of MAF sensor 110 reading changes;

tip_flag=indicates which way the MAF sensor 110 reading is changing.

current_MAF_reading_change=current change in MAF sensor 110 reading;

MAF reading jump=when absolute value of current MAF sensor 110 reading minus past MAF sensor 110 reading exceeds a threshold value;

min_tip_count=lower threshold for the window interpolation, i.e., minimal count window;

max_tip_count=upper threshold for the window interpolation, i.e., maximum count window;

tip_int_duration=length of interpolation;

manifold filling ( )=cylinder air charge estimation is based on manifold filling algorithm ($CAC_{MAF}$);

speed_density ( )=cylinder air charge estimation is based on speed density filling algorithm ($CAC_{MAP}$;

tip transient decay condition=transient has peaked and steady-state condition is to be reached;

tip_int_count—current duration of interpolation process;

current_pip_time=time for a new PIP sensor 118 event.

A number of embodiments of the invention have been described. Nevertheless, it will be understood that various modifications may be made without departing from the spirit and scope of the invention. Accordingly, other embodiments are within the scope of the following claims.

What is claimed is:

1. A system for estimating cylinder air charge in an internal combustion engine, such system comprising:

a manifold absolute pressure sensor, communicating with an intake manifold of the engine;

a mass air flow sensor, communicating with an intake manifold of the engine; and a processor for providing such cylinder air charge estimation from signals produced primarily by the manifold absolute pressure sensor during engine transient conditions, combining signals primarily from both the mass airflow sensor and the manifold absolute pressure sensor to provide such cylinder air charge estimation during a transition period between the transient condition and a steady-state engine condition, and using primarily only the mass airflow sensor to provide such cylinder air charge estimation during the steady-state condition.

2. A system for estimating cylinder air charge in an internal combustion engine, such system comprising:

a processor programmed to:

provide such cylinder air charge estimation using a speed density algorithm during engine transition conditions;

provide such cylinder air charge estimation using a manifold filling algorithm during a steady-state condition; and provide such cylinder air charge estimation by combining the estimation from the manifold filling algorithm with the estimation from the speed density algorithm to provide such cylinder air charge estimation during a period between the transient condition and a steady-state engine condition.

3. The system recited in claim 2 wherein such processor:

uses a smoothing algorithm during the period to interpolate estimations from both the filling algorithm and the speed density algorithm.

4. The system recited in claim 2 wherein the processor:

produces the cylinder air charge estimate using the speed density algorithm;

detecting a transition period;

from such produced cylinder air charge estimate, determines, during the detected transient period, whether such determined cylinder air charge estimate is converging to towards a steady state condition;

if such determined estimate is converging, applies a smoothing algorithm to interpolate the cylinder air charge estimation from both the manifold filling and speed density algorithms in combining the estimation from the manifold filling algorithm with the estimation from the speed density algorithm is used to provide such cylinder air charge estimation during the transition period; and when the steady state condition is reached, uses the manifold filling algorithm to provide the air charge estimation.

5. The system recited in claim 4 wherein the processor:

if such determined estimate is not converging to the steady state condition, then enables the smoothing algorithm, which interpolates the cylinder air charge estimation from both the manifold filling and speed density algorithms, to provide such cylinder air charge estimation during the transition period.

6. The system recited in claim 5 wherein the interpolation is in accordance with:

$$CAC_{FINAL} = \frac{n_p}{n_f} CAC_{MAF} + \frac{n_f - n_p}{n_f} * CAC_{MAP}$$

where:

$CAC_{MAF}$ is the cylinder air charge estimation based on manifold filling algorithm calculation;

$CAC_{MAP}$ is the cylinder air charge estimation based on speed density algorithm calculation;

$n_f$ is the total time duration of the smoothing process; and $n_p$ is the current duration of the smoothing process.

7. A storage media having computer code, such code upon execution:estimating cylinder air charge in an internal combustion engine, such engine having a mass airflow sensor and a manifold absolute pressure sensor communicating with an intake manifold of the engine, comprising:

providing such cylinder air charge estimation from signals produced primarily by the manifold absolute pressure sensor during engine transient conditions, combining signals primarily from both the mass airflow sensor and the manifold absolute pressure sensor to provide such cylinder air charge estimation during a transition period between the transient condition and a steady-state engine condition, and using primarily only the mass airflow sensor to provide such cylinder air charge estimation during the steady-state condition.

8. A storage media having computer code, such code upon execution:

estimating cylinder air charge in an internal combustion engine, comprising:

providing such cylinder air charge estimation using a speed density algorithm during engine transient conditions;

providing such cylinder air charge estimation using a manifold filling algorithm during a steady-state condition; and providing such cylinder air charge estimation by combining the estimation from the manifold filling algorithm with the estimation from the speed density algorithm to provide such cylinder air charge estimation during a transition period between the transient condition and a steady-state engine condition.

9. The storage media recited in claim 8 further:

using a smoothing algorithm during the transition period to interpolate estimations from both the filling algorithm and the speed density algorithm.

10. The storage media claim 8 further:

producing the cylinder air charge estimate using the speed density algorithm;

detecting a transition period;

from such produced cylinder air charge estimate, determining, during the detected transition period, whether such determined cylinder air charge estimate is converging to towards a steady state condition;

if such determined estimate is converging, applying a smoothing algorithm to interpolate the cylinder air charge estimation from both the manifold filling and speed density algorithms in combining the estimation from the manifold filling algorithm with the estimation from the speed density algorithm is used to provide such cylinder air charge estimation during the transition period; and when the steady state condition is reached, using the manifold filling algorithm to provide the air charge estimation.

11. The media recited in claim 10 including:

if such determined estimate is not converging to the steady state condition, then the smoothing algorithm, which interpolates the cylinder air charge estimation from both the manifold filling and speed density algorithms, is used to provide such cylinder air charge estimation during a transition period.

12. The method recited in claim 11 wherein the interpolation is in accordance with:

$$CAC_{FINAL} = \frac{n_p}{n_f} CAC_{MAF} + \frac{n_f - n_p}{n_f} * CAC_{MAP}$$

where:

$CAC_{MAF}$ is the cylinder air charge estimation based on manifold filling algorithm calculation;

$CAC_{MAP}$ is the cylinder air charge estimation based on speed density algorithm calculation;

$n_f$ is the total time duration of the smoothing process; and $n_p$ is the current duration of the smoothing process.

13. A method for estimating cylinder air charge in an internal combustion engine, such engine having a mass airflow sensor and a manifold absolute pressure sensor communicating with an intake manifold of the engine, such method comprising:

providing such cylinder air charge estimation from signals produced primarily by the manifold absolute pressure sensor during engine transient conditions, combining signals primarily from both the mass airflow sensor and the manifold absolute pressure sensor to provide such cylinder air charge estimation during a transition period between the transient condition and a steady-state engine condition, and using primarily only the mass airflow sensor to provide such cylinder air charge estimation during the steady-state condition.

14. A method for estimating cylinder air charge in an internal combustion engine, such method comprising:

providing such cylinder air charge estimation using a speed density algorithm during engine transition conditions;

providing such cylinder air charge estimation using a manifold filling algorithm during a steady-state condition; and providing such cylinder air charge estimation by combining the estimation from the manifold filling algorithm with the estimation from the speed density algorithm to provide such cylinder air charge estimation during a transition period between the transient condition and a steady-state engine condition.

15. The method recited in claim 14 further including:

using a smoothing algorithm during the period to interpolate estimations from both the filling algorithm and the speed density algorithm.

16. The method recited in claim 14 further comprising:

producing the cylinder air charge estimate using the speed density algorithm; detecting the transition period;

from such produced cylinder air charge estimate, determining, during the detected transient period, whether such determined cylinder air charge estimate is converging to towards a steady state condition;

if such determined estimate is converging, applying a smoothing algorithm to interpolate the cylinder air charge estimation from both the manifold filling and speed density algorithms in combining the estimation from the manifold filling algorithm with the estimation from the speed density algorithm is used to provide such cylinder air charge estimation during the transition period; and when the steady state condition is reached, using the manifold filling algorithm to provide the air charge estimation.

17. The method recited in claim 16 including:

if such determined estimate is not converging to the steady state condition, then the smoothing algorithm, which interpolates the cylinder air charge estimation from both the manifold filling and speed density algorithms, is used to provide such cylinder air charge estimation during the transition period.

18. The method recited in claim 17 wherein the interpolation is in accordance with:

$$CAC_{FINAL} = \frac{n_p}{n_f} CAC_{MAF} + \frac{n_f - n_p}{n_f} * CAC_{MAP}$$

where:

$CAC_{MAF}$ is the cylinder air charge estimation based on manifold filling algorithm calculation;

$CAC_{MAP}$ is the cylinder air charge estimation based on speed density algorithm calculation;

$n_f$ is the total time duration of the smoothing process; and $n_p$ is the current duration of the smoothing process.

* * * * *